United States Patent [19]

Donovan

[11] 4,241,660

[45] Dec. 30, 1980

[54] PROJECTILE

[75] Inventor: William F. Donovan, Aberdeen, Md.

[73] Assignee: The United States of America as represented by the Secretary of the Army, Washington, D.C.

[21] Appl. No.: 948,127

[22] Filed: Oct. 3, 1978

[51] Int. Cl.[3] ..... F42B 11/22

[52] U.S. Cl. ..... 102/56 R; 102/38 RA; 102/92.1

[58] Field of Search ..... 102/56, 57, 58, 92, 102/92.1, 38 RA; 244/3.23

[56] References Cited

U.S. PATENT DOCUMENTS

| | | | |
|---|---|---|---|
| 2,011,249 | 8/1935 | Larson | 102/92 |
| 2,884,859 | 5/1959 | Alexander et al. | 424/3.23 |
| 3,628,457 | 12/1971 | Magnusson | 102/49.3 |
| 3,942,443 | 3/1976 | Lyles | 102/49.3 |
| 3,995,550 | 12/1976 | D'Amico, Jr. | 102/92.1 |

*Primary Examiner*—Harold J. Tudor

*Attorney, Agent, or Firm*—Nathan Edelberg; Robert P. Gibson; Max Yarmovsky

[57] ABSTRACT

A spin stabilized projectile is arranged to have variable flight stability. The projectile has a casing with a cavity that contains a given mass of fluid. The cavity is shaped to provide a balanced flow of fluid with respect to the axis of spin as the projectile is trajected. This balanced flow alters the flight stability of the projectile.

7 Claims, 8 Drawing Figures

FIG. 5
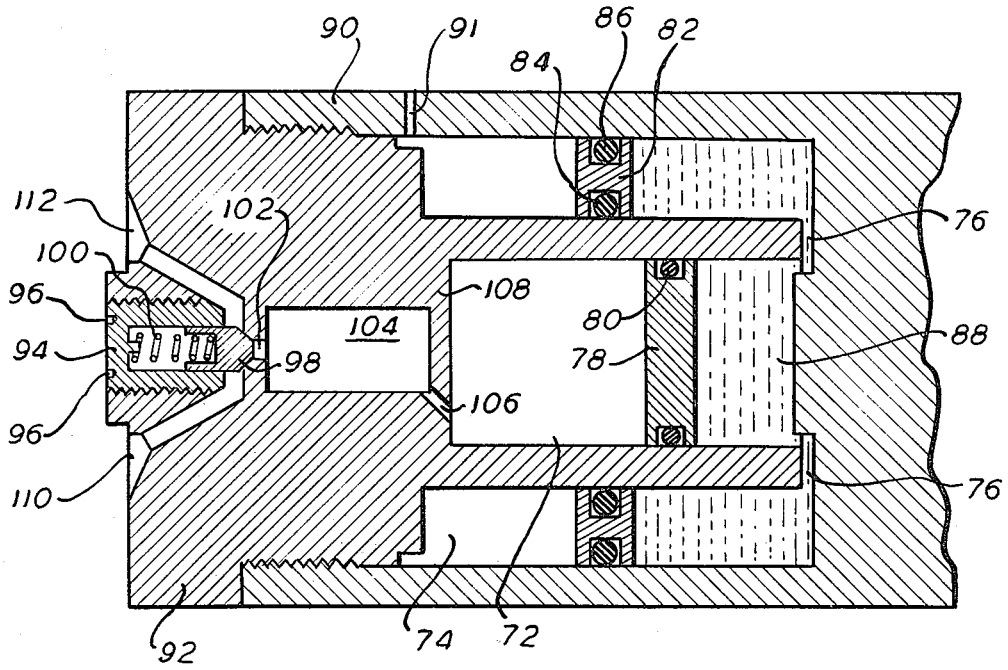
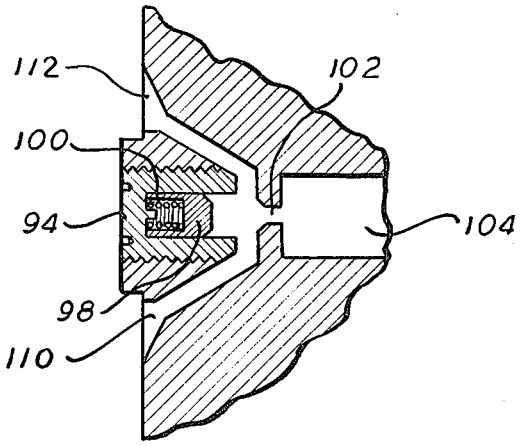
FIG. 6

PROJECTILE

GOVERNMENTAL INTEREST

The invention described herein may be manufactured, used and licensed by or for the Government for Governmental purposes without the payment to me of any royalties thereon.

BACKGROUND OF THE INVENTION

The present invention relates to projectiles and in particular to a projectile having a cavity containing a fluid.

To obtain a satisfactory range from a projectile it is necessary to stabilize its orientation to prevent excessive yaw or pitch. While judicious design of the center of gravity or the inclusion of fins may provide an aerodynamic moment which assures stability, a large class of projectiles rely on spin stabilization. Through the use of rifling, a launched projectile is spun about its longitudinal axis so that it exhibits the wellknown gyroscopic effect. To ensure that a projectile is gyroscopically stabilized its spin rate must exceed a minimum which is determined by factors such as its mass distribution.

A specific cannon or gun having standard rifling does not have the ability to adjust the spin rate or the stability of various projectiles. In order to vary the spin rate a known barrel employed two interlaced riflings having differing twist rates. A projectile having engravings matching the appropriate one of the riflings is manually inserted therein. This approach however, does not allow continuous adjustment of spin rate and does not affect projectile stabilizing characteristics such as its mass distribution. In a known projectile, a slipping obturator is used to reduce the spin rate. This apparatus is exposed to high stress and does not provide for adjustment of stabilizing factors such as the mass distribution of the projectile. In a known launcher, its barrel is spun at a rate appropriate for the projectile being fired. While the spin rate can be adjusted in this apparatus, the highest rate attainable is limited and wear is a problem.

The present invention provides a projectile whose flight stability is controlled by a fluid disposed in a cavity of the projectile. The cavity is arranged to allow shifting of the fluid. The resulting mass redistribution can affect flight stability by altering the moment of inertia or the center of gravity as the projectile is trajected. Such mass redistribution can be utilized to increase or decrease the flight stability, in various embodiments. Also, prior to launch the flight stability can be set by the simple expedient of selecting a specific volume or density of fluid. The setting of stability in this fashion may be performed in the factory or in the field. This latter feature is also useful where a standard shell is to be fitted with any one of variously shaped explosives of differing densities.

In addition, for some embodiments the fluid employed may be a liquid explosive so that dead weight is avoided.

Moreover this shifting of fluid may be arranged to facilitate high angular acceleration during launch, thereby ensuring rapid attainment of the rated spin rate. In some embodiments the fluid shift may occur over a predetermined interval so that the projectile stability varies throughout its trajectory. This feature may be important where it is desired to destabilize the projectile and cause it to fall when it reaches a target.

SUMMARY OF THE INVENTION

In accordance with the illustrative embodiments demonstrating features and advantages of the present invention, there is provided a projectile having variable stability. The projectile is arranged to be spin stabilized. The projectile includes a casing having a cavity. Fluid of a given mass is contained within the cavity. The cavity is shaped to provide a balanced flow of the fluid with respect to the axis of spin as the projectile is trajected. This balanced flow alters the flight stability of the projectile.

BRIEF DESCRIPTION OF THE DRAWINGS

The above brief description as well as further objects, features and advantages of the present invention will be more fully appreciated by reference to the following detailed description of presently preferred but nonetheless illustrative embodiments in accordance with the present invention when taken in conjunction with the accompanying drawings wherein:

FIG. 5 is a cross-sectional view, broken on the right, of a third embodiment of a projectile of the instant invention; and;

FIG. 6 is a detail view of the normally closed valve means of FIG. 5, showing that valve open.

DETAILED DESCRIPTION OF THE PREFERRED EMBODIMENTS

Figure 1:
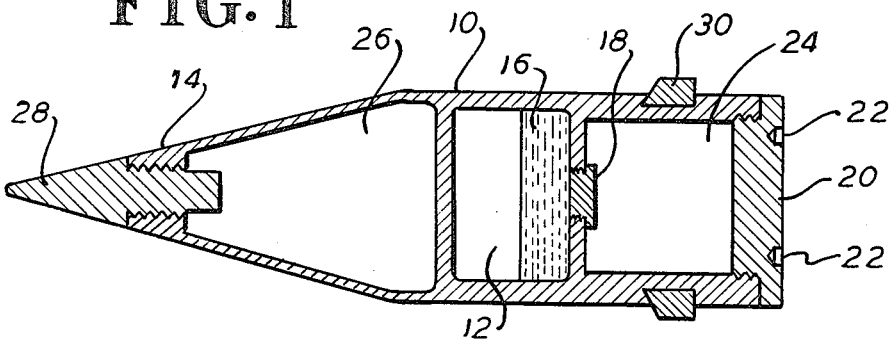
FIG. 1 is a cross-sectional view of a projectile of the instant invention.

Referring now specifically to the drawings, in FIG. 1 a projectile is shown therein as a casing 10 having a cylindrical cavity 12. While the outline of casing 10 is essentially that of a cylinder with a tapered forward end 14, it is apparent that other shapes including blunt nosed shapes may be employed. Also, cavity 12 may be sized, shaped and located differently than shown and may in some embodiments have a frustro-conical or bell shape. Moreover, as described hereinafter cavity 10 may be multi-chambered. The considerations underlying such cavity design are discussed subsequently. These cavities are shaped, however, to provide a balanced flow about the longitudinal axis of the projectile. While axially symmetric shapes will normally provide balanced flows, other shapes such as a non-symmetrical manifold can be shaped to provide such balance.

A fluid is shown herein as liquid explosive 16. In this embodiment it fills about 40% of cavity 12 although this percentage can be significantly altered to suit the geometry of cavity 12 and casing 10 and to provide the desired gyroscopic stability. In other embodiments the ullage of cavity 12 may be taken up by an immiscible liquid having a density differing from that of fluid 16. Eliminating ullage in this fashion cannot only influence gyroscopic stability but may be useful for eliminating splashing or for delaying fluid shift. For reasons given hereinafter cavity 12 may also advantageously employ inwardly projecting paddles for affecting fluid translation. Cavity 12 is sealed with bolt 18.

The aft end of the projectile is capped by base plate 20 which has a threaded inner end and an outer end having a diameter matching that of casing 10. A pair of wrench holes 22 are provided which accept a spanner wrench. Aft cavity 24 and forward cavity 26 are to be filled with appropriate explosives. For example, a shaped charge with a conical metal liner (not shown) may be suitably installed in forward cavity 26, although other warheads may be employed. The forward cavity is sealed and capped by a well-known point detonating fuse 28, which initiates the explosive train upon impact. Fitted into a circumferential groove in casing 10 is a conventional rotating band-obturator 30.

At set back, the projectile of FIG. 1 is violently accelerated, causing fluid 16 to flow rearward and form the cylinder illustrated herein. If the projectile is launched through a barrel incorporating rifling, the projectile will also be angularly accelerated to produce spin. This spinning motion is imparted to fluid 16 which is vortically impelled by the walls of cavity 12. As previously mentioned, inwardly projecting paddles may be affixed to the walls of cavity 12 to reduce, if desired, any lag between the spin rates of casing 10 and fluid 16.

Figure 2A:
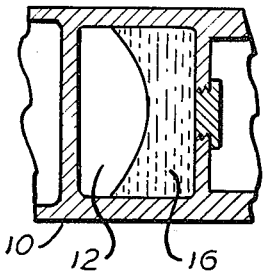
FIGS. 2A, 2B and 2C are partial views of the fluid cavity of FIG. 1 showing shifting of the fluid therein.
Figure 2B:
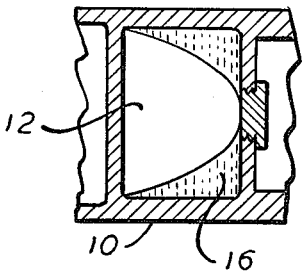

As the spinning projectile accelerates toward the muzzle (not shown) the surface of fluid 16 has the concave parabolic shape illustrated in FIG. 2A. The shape taken is determined by the reactive force on the liquid caused by its forward acceleration and the centrifugal force caused by its revolution. As is well known, the former force is proportional to the product of the fluid mass and its acceleration while the latter force is proportional to the product of the fluid mass, its radial position and the square of its angular velocity. The depth of the concave surface of fluid 16 will be a direct function of this centrifugal force and an inverse function of this reactive force due to forward acceleration. Accordingly a higher angular velocity or lower forward acceleration can produce the deeper vortex shown in FIG. 2B.

After leaving the muzzle, the forward acceleration of the projectile will be zero while its spin rate (angular velocity) will be about maximum. Since this condition corresponds to maximum centrifugal and zero rearward force, fluid 16 is propelled radially outward to form the cylindrical annulus shown in FIG. 2C.

Figure 2C:
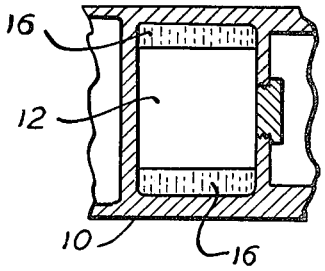

To appreciate the effect of the transformation of fluid 16 from the solid cylindrical shape of FIG. 1 to the annular shape of FIG. 2C, the gyroscopic qualities of a projectile will be briefly considered. The well-known gyroscopic stability factor is proportional to:

$$p^2(Ix)^2/Iy\ (Cm)$$

where Cm is the well-understood static moment coefficient about the center of gravity of the projectile, p is the spin rate of the projectile and Ix is the moment of inertia about this axis of spin. The moment of inertia about an axis orthogonal to that of moment Ix, through the projectile's center of gravity, is referred to as moment Iy. Increase in this gyroscopic stability factor corresponds to enhanced flight stability. It will be readily observed that the numerator of the foregoing expression is essentially the angular momentum associated with projectile spin, squared. Accordingly, conservation of momentum requires that any fluid transformations occurring in free flight will not affect this numerator. The magnitude of this numerator will be established by the spin p attained and the moment of inertia Ix existing at the muzzle. Spin p will be primarily determined by the rifling. The moment of inertia Ix will be determined by the specific shape of fluid 16, as exemplified in FIGS. 2A and 2B.

Once in flight, the denominator of the foregoing expression may change, although the numerator is invariant. While shifting of fluid 16 (FIGS. 1 and 2C) can displace the center of gravity of the projectile, thereby affecting the static moment coefficient Cm, a predominating effect for this embodiment is variation in the transverse moment of inertia Iy. In this embodiment the transverse moment Iy decreases to cause an increase in gyroscopic stability. The respective transverse moments of inertia of the fluid 16 in the configurations of FIGS. 1 and 2C may be readily obtained using well known formulas. These moments of inertia are taken with respect to the center of gravity of the projectile. For the embodiment of FIGS. 1 and 2C, this center is, for practical purposes, located in the center of cavity 12. While the shifting of fluid 16 may shift the center of gravity, this small effect will not be considered in the following analysis.

To calculate such variation in the moment of inertia, the moment of inertia of an annular cylinder, having an outside diameter D2 and inside diameter D1, about a central transverse diameter is obtained from the well known formula (unit mass assumed):

$$D1^2/16+D2^2/16+(Lc+d)^2/12$$

where the bracketed quantity equals the length of the annular cylinder but expressed as the sum of the length Lc of the solid fluid cylinder of FIG. 1 and the length d of its resulting empty cylinder. The moment of inertia about a central diameter in cavity 12 for fluid 16 in FIG. 1 may be obtained using the well known parallel axis theorem. It is apparent that the center of gravity of fluid 16 for FIG. 1 is offset d/2 from the axis of rotation so that its moment of inertia is (unit mass assumed):

$$D2^2/16+(Lc)^2/12+d^2/4$$

The net decrease in moment of inertia is obtained by subtracting the former expression from the latter and substituting the term e for the ratio of d/Lc. The resulting expression is:

$$\frac{Lc^2\, e(e-1)}{6} - \frac{D1^2}{16}$$

It is immediately observed that for the moment of inertia to decrease, the above expression must be positive. As a result, e must exceed unity which requires the cavity 12 to be less than 50% full. With this in mind, the size, fullness and slenderness of cavity 12 may be chosen to provide the desired decrease in moment of inertia. Moreover, the foregoing expression assumes unit mass and therefore it can be generalized by multiplying by the mass of fluid 16.

Accordingly it is apparent that by the simple expedient of altering the volume or density of fluid 16 gyroscopic stability during free flight can be readily increased or decreased. In this fashion the extent of fluid shifting occurring after setback, can be used to establish the desired gyroscopic stability.

Figure 3:
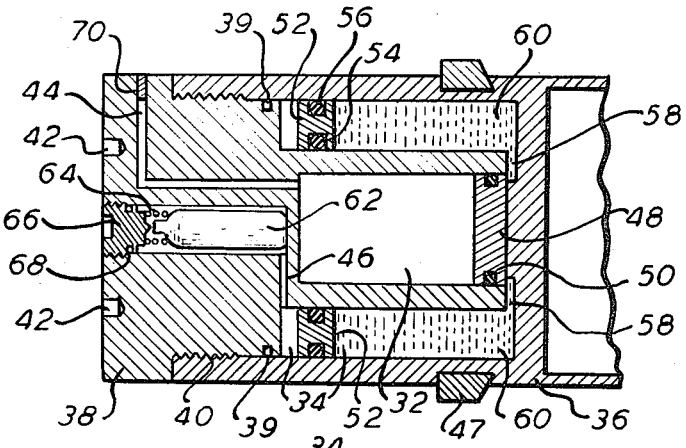
FIG. 3 is a cross-sectional view, broken on the right, of a second embodiment of a projectile of the instant invention.

Referring to FIG. 3 an alternate embodiment is illustrated in which a projectile is shown having a pair of chambers 32 and 34. While this pair is shown as an inner cylindrical chamber 32 coaxially disposed within an outer annular chamber 34 having opposing cylindrical surfaces, other arrangements are possible. For example, either one of the pair of chambers 32 or 34 may be a multi-chambered manifold which is longitudinally displaced from the other. The specific arrangement is chosen to provide the desired change in gyroscopic stability.

The projectile casing is formed of flight body 36, which is broken on the right for illustrative purposes, and pedestal 38. Body 36 and pedestal 38 are attached together by threads 40, threading being facilitated by spanner wrench holes 42 in pedestal 38. Body 36 and pedestal 38 are sealed by toroidal gasket 39 (O ring) which is disposed in a rectangular circumferential groove in pedestal 38. Both body 36 and pedestal 38 are axially symmetric and may be considered solids of revolution, with the exception of holes 42 and passageways 44 and 46 which passageways are described hereinafter. Fitted into a circumferential groove in body 36 is conventional rotating band obturator 47.

Fitted into inner chamber 32 is inner piston 48 which is shown as a relatively short cylinder with a circumferential groove containing a toroidal gasket 50. Fitted into outer chamber 34 is outer annular piston 52 having an inner and outer circumferential groove containing toroidal gaskets 54 and 56, respectively. Pistons 52 and 48 may, of course, be shaped differently in other embodiments and may employ cross-sections which are circular, hollow, pitched etc.

Communication between the forward ends of chambers 32 and 34 is provided by passageway 58 which allows fluid 60 to flow radially between them. Fluid 60 is trapped between pistons 48 and 52 whose respective gaskets 50, 54 and 56 prevent fluid 60 from bypassing these pistons. So configured, a forward force on outer piston 52 applies hydraulic pressure on inner piston 48, tending to drive it backwards. For well understood reasons, forward motion of piston 52 produces displacement of piston 48 in inverse proportion to the surface area it presents to fluid 60.

A drive means is shown herein having a source of pressurized gas disposed in an elongated chamber. In this embodiment the source is gas capsule 62 disposed in an axial circular bore in pedestal 38. It is apparent that other drive means are possible and, in fact, an alternative is illustrated hereinafter. Means for urging capsule 62 forward is provided by coil spring 64 which bears against anvil 66. Anvil 66 has a generally cylindrical shape but with a small pointed projection on its forward surface and a wrench hole in its rear surface. Anvil 66 is threaded into pedestal 38 and sealed thereto by toroidal gasket (O ring) 68. Capsule 62, containing pressurized $CO_2$ or other gaseous propellants, has an aft frangible seal aligned with the pointed projection of anvil 66. As an alternative to a pressurized capsule, a source of pressurized gas may be provided by a detonatable cartridge (appearing similar to capsule 62) which is detonated by collision with a trigger means such as anvil 66.

Passageway 46 provides communication between the bore containing capsule 62 and the aft of outer chamber 34. Passageway 44 is sealed with plug 70 which is pressure ejectable. Dislodging of plug 70 vents the aft of inner chamber 32.

Figure 4:
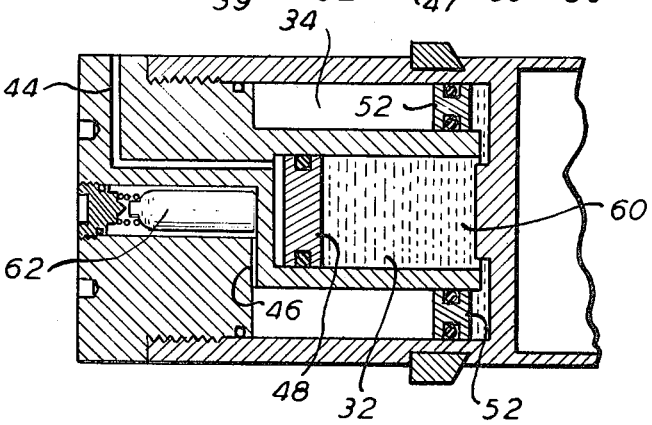
FIG. 4 is a view similar to that of FIG. 3 but in which fluid shift has occurred.

To facilitate an understanding of the embodiment of FIG. 3 its operation will be briefly described in conjunction with FIG. 4. At set-back the projectile is instantaneously accelerated causing capsule 62 to recoil and impale its frangible seal against the pointed projection of anvil 66. When launched into free flight, forward acceleration ceases and capsule 62 is urged to the position shown in FIG. 3, releasing its pressurized $CO_2$. This pressurized gas communicates with the aft of outer chamber 34 by means of passageway 46. It will be observed that capsule 62 is loosely fitted into its axial bore to allow gas to bypass it. The resulting pressure on the aft face of outer piston 52 causes it to slide forward and piston 48 to slide aftward, for the reasons previously given. The aftward translation of piston 48 creates a back-pressure in passageway 44 which dislodges plug 70 and vents the aft of chamber 32 (FIGS. 3 and 4). Under such circumstances, pistons 48 and 52 and fluid 60 are free to shift to the positions shown in FIG. 4. This motion ceases upon either piston 52 or 48 abutting the end of its respective chamber—provided capsule 62 has sufficient drive capacity.

It is apparent that the fluid transformation illustrated by FIGS. 3 and 4 effectively condenses a hollow cylinder of uniform wall thickness into a solid fluid cylinder. It is also apparent that the initial and final centers of gravity of fluid 60 are approximately coincident. This being the case, the moment of inertia of fluid 16 with respect to anyone of its diameters is less for the final fluid configuration of FIG. 4. This decrease may be perceived intuitively as a result of the condensed solid cylinder having more fluid elements closer to the transverse axis. By assuming the interspace between chambers 32 and 34 is negligibly small, the decrease in this moment of inertia may be approximated as 1/16 of the product of the mass of fluid 60 and the square of the diameter of chamber 32. A more detailed analysis, using well known mathematical techniques, could evaluate the influence of any shift in the center of gravity of fluid 60, to obtain a more accurate estimate of the moment of inertia variation.

The fact that the outer chamber 34 encompasses chamber 32 together with the fact that the center of gravity of fluid 60 does not appreciably shift, is advantageous. The length to thickness ratios of chambers 32 and 34 may be varied significantly without eliminating the decrease in moment of inertia caused by the foregoing fluid transformation. In comparison, the fluid transformation from FIG. 1 to FIG. 2C decreases the moment of inertia about a transverse diameter through the projectile's center of gravity by moving into coincidence therewith the center of gravity of fluid 16. This effect in FIGS. 1 and 2C, however, is offset by the fact that the moment of inertia of fluid 16 about its own center of gravity is less for the initial position of FIG. 1. Thus for the embodiment of FIG. 1, some cavity shapes provide insufficient shift in fluid center of gravity so that this effect is overcome by the higher inherent moment of inertia for the fluid shape of FIG. 2C.

In contrast, the arrangement of FIGS. 3 and 4, by eliminating reliance on the shift in center of gravity, avoids countervailing phenomena which can reduce the net change in moment of inertia about a diametric axis.

Referring to FIG. 5 an inner chamber 72 is encompassed by an outer annular chamber 74 which intercommunicate by means of radial passageway 76. Fitted within inner chamber 72 is a relatively short cylindrical piston 78 having a circumferential groove containing toroidal gasket 80. An annular piston 82 has opposing circumferential grooves on its inside and outside surface which contain toroidal gaskets 84 and 86, respectively. The foregoing describes a hydraulic system which operates with fluid 88 and which cooperates in the same manner as previously described in connection with FIG. 3. In distinction to FIG. 3, the pistons in the apparatus of FIG. 5 are to be driven in directions opposite to that of FIG. 3. To this end flight body 90 has a circular aperture 91 which vents the aft end of chamber 74.

Threaded into body 90 is pedestal 92 which, except for certain passageways hereinafter described, is essentially a solid of rotation. Threaded into the aft end of pedestal 92 is cup shaped plug 94, threading being facilitated by a pair of spanner wrench holes 96.

A normally closed valve means is shown herein as a tapered valve member 98 having a cupped shape. Member 98 is urged forward by a yieldable means, shown herein as coil spring 100. It is apparent that other valve devices including various check valves may be employed herein as alternatives. In the position shown, valve member 98 seals inlet port 102 which communicates with cylindrical plenum 104. Plenum 104 communicates with the aft of inner chamber 72 by means of circular passageways 106 and 108. Valve member 98 is exposed to ambient pressure by a pair of skewed passageways 110 and 112 which are vented to ambient. It is to be understood that during launch, the ambient will be a high pressure gun gas.

At set back two forces tend to retract valve member 98: recoil forces and a high pressure gun gas bearing upon its tapered surface. In response, valve member 98 retracts as shown in FIG. 6. Under this condition port 102 is opened and a high pressure gun gas passes therethrough, pressurizing plenum 104. As the projectile reaches the muzzle, acceleration and ambient pressure rapidly decline, so that spring 100 overcomes these effects and returns member 98 to the position shown in FIG. 5. Upon closing, valve member 98 seals port 102, entrapping high pressure gas in plenum 104.

The high pressure of plenum 104 is communicated to the aft face of piston 78 driving it forward. In a manner analogous to the hydraulically coupled pistons of FIG. 3, the pistons 78 and 82 move in opposite directions, in inverse proportion to the surface area each presents to fluid 88. In contrast to the arrangement of FIG. 3, this arrangement shifts fluid 88 to outer chamber 74 which, for reasons previously given, causes a decrease in gyroscopic stability. Such a feature may be useful for practice projectiles whose range must be limited to avoid unforeseeable damage. Alternatively, the size of passageway 76 may be constricted or the viscosity of fluid 88 may be so great that the shift of fluid 88 occurs over a predetermined time interval. This feature may be used to destabilize the projectile at a given range at which a target is located.

From the foregoing it is apparent that various shaped cavities containing shiftable fluid may be designed in accordance with the teachings of the present invention. Moreover, various components in the several embodiments may be interchanged. Also the size, location, density and viscosity of the components herein disclosed may be altered to provide a desired stability, weight, center of gravity etc. Obviously many other modifications and variations of the present invention are possible in light of the above teachings. It is therefore to be understood that within the scope of the appended claims, the invention may be practiced otherwise than as specifically described.

I claim:

1. A projectile having variable stability, said projectile being arranged to be spin stabilized and comprising:

a casing having a cavity wherein said cavity is shaped to provide a pair of chambers, each communicating with the other;

a fluid of a given mass contained within said cavity;

drive means for propelling said fluid between said pair of chambers, said pair of chambers includes;

an inner chamber and an outer chamber encircling said inner chamber, said drive means including a source of pressurized gun gas; and an inner piston slidably mounted in said inner chamber;

an outer annular piston slidably mounted in said outer chamber, said fluid being contained between said inner and outer pistons; and said cavity being shaped to provide a balanced flow of said fluid with respect to the axis of spin as said projectile is trajected, said balanced flow altering the flight stability of said projectile.

2. A projectile according to claim 1 wherein said source of pressurized gas communicates with said outer chamber to drive said outer piston and propel said fluid into said inner chamber, said inner chamber being sized and disposed to decrease the moment of inertia about a transverse axis as said fluid flows into said inner chamber.

3. A projectile according to claim 1 wherein said drive means propels said fluid in a direction to increase its moment of inertia about a transverse axis, said drive means destabilizing said projectile after the elapse of a predetermined interval to hasten the descent of said projectile.

4. A projectile according to claim 1 wherein said casing has an elongated chamber communicating with said cavity, said drive means comprising:

a gas capsule having a frangible seal and slidably mounted in said elongated chamber, said casing having a pointed anvil projecting into said elongated chamber adjacent said frangible seal, forward acceleration of said projectile in excess of a predetermined amount impaling said frangible seal against said anvil.

5. A projectile according to claim 1 wherein said casing has an elongated chamber communicating with said cavity, said drive means comprising:

a detonatable cartridge slidably mounted in said elongated chamber, said cartridge being operative to pressurize said elongated chamber and displace said fluid;

a trigger means for igniting said cartridge upon collision therewith; and means for urging said cartridge away from said trigger means, a given amount of forward acceleration of said projectile impelling said cartridge against said trigger means to ignite said cartridge.

6. A projectile according to claim 1 wherein said fluid comprises a liquid explosive.

7. A projectile according to claim 1 wherein said pair of chambers are spaced to longitudinally shift the center of gravity of said projectile in response to transfer of said fluid between said pair of chambers.

* * * * *